United States Patent [19]

Stahly et al.

[11] 4,428,353

[45] Jan. 31, 1984

[54] RPM BIAS REGULATOR VALVE

[75] Inventors: Daniel C. Stahly, Elmhurst; Andrew A. Kenny, Roselle, both of Ill.

[73] Assignee: Eaton Corporation, Cleveland, Ohio

[21] Appl. No.: 315,739

[22] Filed: Oct. 28, 1981

[51] Int. Cl.[3] ..... F02M 25/06

[52] U.S. Cl. ..... 123/568; 123/389; 123/407; 123/418; 137/116.5

[58] Field of Search ..... 123/389, 407, 408, 418, 123/568, 569; 137/116.5

[56] References Cited

U.S. PATENT DOCUMENTS

| | | | |
|---|---|---|---|
| 2,473,171 | 6/1949 | Ostling | 123/418 |
| 2,731,523 | 1/1956 | Downing | 123/407 |
| 2,739,582 | 3/1956 | Udale | 123/407 |
| 3,476,316 | 11/1969 | Franz | 237/2 |
| 3,500,722 | 7/1970 | Franz et al. | 91/446 |
| 3,503,377 | 3/1970 | Beatenbough et al. | 123/407 |
| 3,545,472 | 12/1970 | Franz | 137/116.5 |
| 3,770,195 | 11/1973 | Franz | 236/13 |
| 3,831,841 | 8/1974 | Franz | 236/13 |
| 4,159,702 | 7/1979 | Akman | 123/418 |
| 4,196,707 | 8/1980 | Stoltman | 123/571 |
| 4,226,220 | 10/1980 | Suzuki et al. | 123/408 |
| 4,245,780 | 1/1981 | Franz | 236/13 |
| 4,269,159 | 5/1981 | Skinner | 123/569 |
| 4,280,470 | 7/1981 | Ueda | 123/569 |
| 4,295,450 | 10/1981 | Nomura et al. | 123/569 |
| 4,369,753 | 1/1983 | Sugiyama | 123/569 |

FOREIGN PATENT DOCUMENTS

| | | | |
|---|---|---|---|
| 662404 | 4/1963 | Canada | 123/408 |

*Primary Examiner*—Wendell E. Burns

*Attorney, Agent, or Firm*—Fay & Sharpe

[57] ABSTRACT

The RPM bias valve combines a first fluid signal which varies inversely with the throttle position or with other engine conditions and a second fluid signal which varies with engine speed to produce a modulated output signal which varies as a function of both. A pressure responsive diaphragm (68) separates a first signal chamber (62) and a modulated output signal chamber (66). The diaphragm is also biased by an extension spring (90) which is connected with a cam follower (104). The position of the cam follower, hence, the biasing force or pressure applied by the extension spring, is controlled by a cam (102) and a rolling diaphragm (106) which is operated upon by the second fluid signal. A first valve (70) selectively connects the first and modulated signal chambers to reduce the vacuum in the modulated output signal chamber when the pressure responsive diaphragm (68) is out of its equilibrium position in one direction. A second valve (72) selectively provides fluid communication between the modulated output signal chamber and a vacuum supply port (56) when the pressure reponsive diaphragm (68) is out of its equilibrium position in the other direction. In this manner, a change in the pressure on the diaphragm (68) from the second fluid signal or from the first fluid signal by way of the extension spring (90) causes the diaphragm to move in such a manner that the appropriate one of the first and second valves is opened to adjust the vacuum in the modulated output signal chamber (66) to restore the diaphragm to the equilibrium position. The modulated output signal from the modulated output signal chamber thus varies as a function of both the first and second fluid signals.

35 Claims, 3 Drawing Figures

RPM BIAS REGULATOR VALVE

BACKGROUND OF THE INVENTION

This application pertains to the art of fluid signal regulation and modulation. The invention finds particular application in automotive pneumatic pressure, particular vacuum, control systems. More specifically, the invention finds application in modulating exhaust gas recirculation (EGR) controlling vacuum signals as a function of engine speed (RPM) as well as throttle position. It is to be appreciated, however, that the invention is applicable to controlling fuel flow as a function of engine speed and altitude and for amplifying, regulating, combining, or modulating fluid signals in other control applications.

Heretofore, automotive EGR valves on diesel engines have been opened progressively with increasing engine throttle position only. Commonly on diesel engines, EGR control system include a throttle position to vacuum signal transducer which produces a regulated signal that varies inversely with throttle position. The regulated signal is used to operate a vacuum motor which, in turn, operates the EGR valve.

Commonly, kinetic/pneumatic transducers are utilized in automotive and other applications for converting variations in mechanical energy into variations in a vacuum signal. Such transducers are shown, for example, in the temperature regulator assemblies illustrated in U.S. Pat. Nos. 4,245,780, 3,831,841, and 3,770,195 all to R. J. Franz. In these temperature regulator assemblies, the mechanical force from a bi-metalic element modulates a vacuum signal to produce a vacuum output which varies as a function of temperature. Another application for such transducers is for controlling an automotive blend-air system, such as illustrated in U.S. Pat. No. 3,476,316 to R. J. Franz. The blend-air control system includes a cam which is moved in response to engine temperature to provide a vacuum signal which varies with engine temperature. The vacuum signal is used to adjust the position of a blend-air door that varies the percentage of air passing to the carburator through a heat exchanger.

The present invention provides a modulator or regulator valve which produces an output signal that is a function of two variables, thus overcoming the limitations associated with single variable control systems.

SUMMARY OF THE INVENTION

In accordance with one aspect of the present invention, there is provided a vehicular EGR valve control system. A first transducer monitors throttle position and produces a throttle position signal which varies with throttle position. An engine speed monitoring means monitors the engine speed and produces an engine RPM signal which varies with engine speed. A modulator means modulates the throttle position signal and the engine RPM signal to produce a modulated output signal which varies as a function of throttle position and engine speed. An EGR valve control means controls an EGR valve. The EGR valve control means is operatively connected with the modulator means to control the EGR valve as a function of throttle position and engine speed.

In accordance with another aspect of the present invention, there is provided a vehicular signal modulation system for producing a modulated output signal which varies as a function of at least a first condition and a second condition. A first transducer monitors the first condition and produces a first fluid signal which varies with the first condition. A second transducer monitors the second condition and produces a second fluid signal which varies with the second condition. A modulator valve modulates one of the first and second fluid signals with the other to produce a modulated output signal which varies with the first and second conditions.

In accordance with yet another aspect of the invention, there is provided a modulator valve for modulating a first fluid signal and a second fluid signal. The valve includes means for defining a first fluid signal receiving port, a second fluid signal receiving port, a modulated output signal port and a fluid pressure supply receiving port. A first signal chamber is disposed in fluid communication with the first fluid signal port means and a modulated output signal chamber is disposed in fluid communication with the modulated output signal port means. A movable, pressure responsive means is disposed to receive opposing forces from fluid pressure in the first signal chamber and the modulated output signal chamber. An adjustable biasing means applies an adjustable biasing force to the pressure responsive means. A modulating means in fluid communication with the second signal port means adjusts the biasing force of the adjustable biasing means. A first valve means selectively provides fluid communication between the first signal chamber and the modulated output signal chamber in response to the pressure responsive means moving from the equilibrium position in a first direction. A second valve means selectively connects the modulated output signal chamber with the fluid pressure supply port means in response to the pressure responsive means moving from the equilibrium position in a second direction. In this manner, the first and second valve means adjust the pressure in the modulated signal chamber such that the pressure responsive means is returned to the equilibrium position.

A primary advantage of the present invention is that it modulates a received pneumatic signal with a control signal to produce a modulated signal that varies as a function of both the received signal and the control signal.

Another advantage of the present invention is that it is adapted to produce a modulated vacuum signal which varies as a function of both of the throttle position of a diesel engine and the diesel engine speed or RPM.

Yet another advantage of the present invention is that it provides better control of the exhaust gas recirculation valve of diesel engines.

Still other advantages of the present invention will become apparent to others upon reading and understanding the following detailed description of the preferred embodiment.

BRIEF DESCRIPTION OF THE DRAWINGS

The invention may take form in various parts and arrangements of parts. The drawings are for the purpose of illustrating a preferred embodiment of the invention only and are not to be construed as limiting the invention.

DETAILED DESCRIPTION OF THE PREFERRED EMBODIMENT

Figure 1:
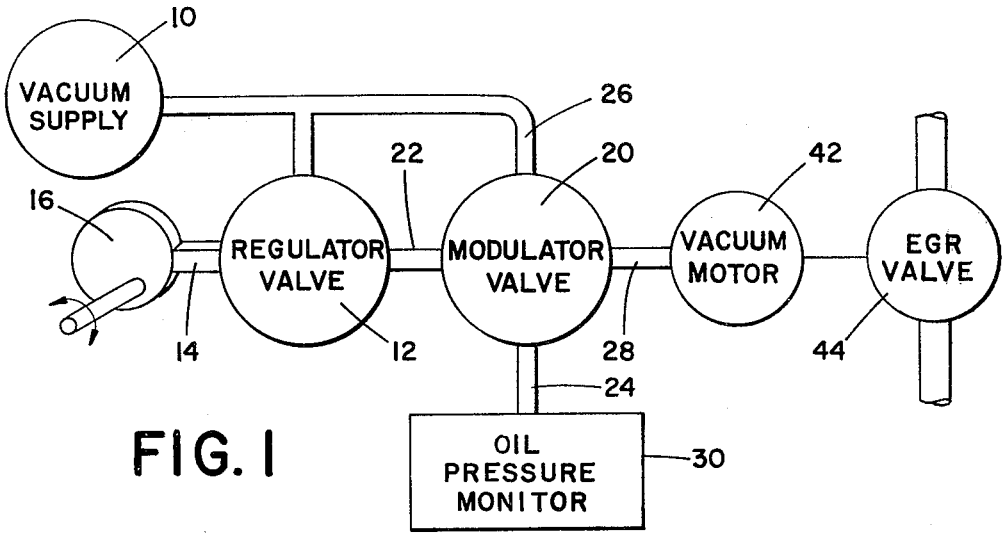
FIG. 1 is a diagramitic illustration of a diesel engine EGR control system in accordance with the present invention.

With reference to FIG. 1, there is provided a fluid pressure, more specifically a vacuum, supply means 10 which supplies a generally constant fluid pressure. In diesel automotive engines, the pressure supply means commonly supplies a 24 in. Hg. vacuum. Connected with the vacuum supply means 10 is a first transducer 12 which monitors a first condition and produces a first fluid signal which varies with the first condition. The first transducer is connected by a cam follower 14 with a throttle cam 16. In the preferred embodiment, the first transducer is a regulator valve which regulates or varies the first fluid signal in accordance with the position of the the throttle cam. More specifically, the first fluid signal or throttle position signal varies inversely with throttle advancement. A suitable regulator valve is described in copending application Ser. No. 146,903, filed May 5, 1980 and assigned to the assignee herein, the disclosure of which is encorporated herein by reference.

A modulator valve 20 modulates or combines the first or the throttle position signal as a function of a second fluid signal to produce a modulated output signal. The modulator valve has a first signal input 22 on which it receives the throttle position signal, a second signal input 24 on which it receives the second fluid signal, a vacuum supply input 26 and a modulated output 28. The second signal input 24 is connected with a second transducer 30 which monitors a second condition and causes the second fluid signal to vary with the second condition. In the preferred embodiment, the second transducer is an engine speed monitor 30 and the second signal varies with engine speed (RPM). The engine speed monitor 30 is an oil pressure monitor that monitors the oil pressure of the transfer oil injector pump of the diesel engine and the engine RPM signal is the transfer oil injector pump pressure. Although heretofore unused for speed monitoring functions, the transfer injector pump oil pressure conventionally varies with engine speed over a range of about 30 to 100 psi.

The modulator valve 20, in the preferred embodiment, modulates or combines the throttle position signal and the engine RPM signal. Either an advance in throttle position or a decrease in engine speed acts to decrease the modulated output signal; either a reduction in throttle position or an increase in speed acts to increase the modulated output signal. For example, if an automobile cruising at the speed and throttle position denoted by point 32 of FIG. 2 decides to accelerate, the advance in the throttle position drops the throttle position signal, e.g., to point 34 on line 36. The drop in the throttle position signal from 12 to 3 in. Hg. while the engine RPM signal remains at 60 PSI drops the modulated output signal from 20½ in. Hg. to 9½ in. Hg. As the automobile accelerates with a constant throttle position, line 36 continues to denote the modulator valve operating characteristics. At a speed corresponding to a transfer oil injector pump pressure of 80 psi point 38, the operator lets up on the throttle to hold the higher speed. During the acceleration, the modulated output signal increased from 11½ to 16½ in. Hg. If a throttle position corresponding to a throttle position signal of 9 in. Hg., point 40, is sufficient to maintain the higher speed, the modulated output signal jumps from 16½ to 21½ in. Hg.

Connected with the modulator valve 20 is a vacuum motor 42 which controls an exhaust gas recirculation (EGR) valve 44. The greater the vacuum signal, the farther the EGR valve is opened. Thus, in the above example, advancing the throttle from points 32 to 34 partially closes the EGR valve 44. As the engine speed increases between points 34 and 38, the EGR valve became more open. When the throttle position is reduced between points 38 and 40, the EGR valve opens farther.

Figure 3:
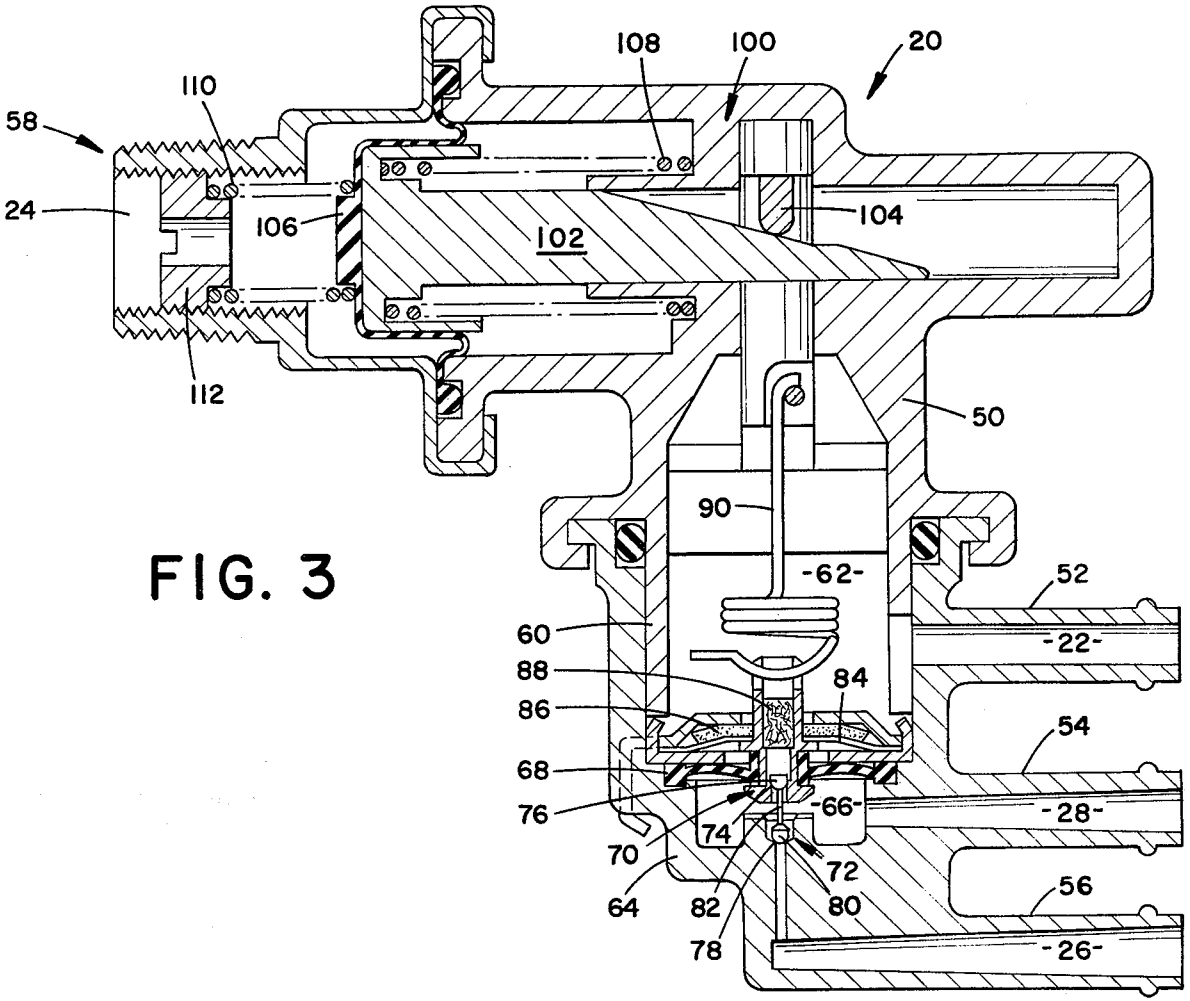
FIG. 3 is a cross sectional view of the modulator valve of FIG. 1 for producing a modulated output signal which varies as a function of two input signals.

With reference to FIG. 3, the modulator valve 20 includes a housing 50. The housing 50 includes a first or throttle position signal receiving port means 52 for defining the first signal input 22, a modulated output signal port means 54 for defining the modulated signal output 28, vacuum supply receiving port means 56 for defining the vacuum supply input 26, and a second or engine RPM signal receiving port means 58 for defining the second signal input 24. The housing 50 further includes means 60 for defining a first input or throttle position signal chamber 62 and means 64 for defining a modulated output signal chamber 66. The throttle position signal chamber 62 is connected with the throttle position port means 52 and the modulated output signal chamber 66 is connected with the modulated output signal port means 54. Disposed between the throttle position and modulated output signal chambers is a movable, pressure responsive means 68. In the preferred embodiment, the pressure responsive means 68 is a flexible diaphragm, although pistons and other devices which move in response to a pressure differential between the throttle position and modulated output signal chambers are contemplated by the present invention. Optionally, the pressure responsive means may present a larger surface area to one of the chambers than the other to provide signal amplification.

A first valve means 70 is connected with the pressure responsive means 68 for selectively permitting or denying fluid communication between the throttle position and modulated output signal chambers. The first valve means is operatively connected with the pressure responsive means 68 such that it is opened to permit the fluid communication in response to the pressure responsive means 68 moving from an equilibrium position (illustrated in FIG. 3) toward the modulated output signal chamber 66. A second valve means 72 selectively permits and denies fluid communication between the vacuum supply first means 56 and the modulated output signal chamber 66. The second valve means 72 is opened to permit the fluid communication in response to the pressure responsive means 68 moving from its equilibrium position away from the modulated output signal chamber 66.

More specific to the preferred embodiment, the first valve means 70 includes a movable valve seat 74 which is connected with the pressure responsive means 68 for movement therewith. Disposed adjacent the movable valve seat 74 is a first valving member 76 which selectively seats against the movable valve seat for opening and closing the first valve means 70. The second valve means 72 includes a stationary valve seat 78 and a second valving member 80 for selectively seating against the stationary valve seat. The first and second valving members 76 and 80 are operatively connected together to undergo coordinated relative movement by a rod 82 or the like.

A spring 84 biases the pressure responsive means 68 toward the equilibrium position. A resilient sealing means 86 protects the pressure responsive means 68 from dirt and the like which may be received in the throttle position signal chamber 62 and damps the motion of valve seat 70. A filter 88 is disposed between the throttle position signal chamber 62 and the first valve means 70 to protect it from being fouled with dirt or the like from the throttle position signal chamber.

An adjustable biasing means such as an extension spring 90 with the spring 84 biases the pressure responsive means 68 toward the equilibrium position. The adjustable biasing means 90 provides a positive biasing force or offset which is additive to the vacuum in the throttle position signal chamber 62. In this manner, the equilibrium position is attained when the force or pressure from the adjustable biasing means 90, the force from the spring 84, the pressure in the throttle position signal chamber 62 and the pressure in the modulated output signal chambers 66 sum to zero. Connected with the adjustable biasing means 90 is a modulating means 100 for adjusting as a function of the second or engine RPM signal the force or pressure applied by the adjustable biasing means. The modulating means 100 includes a cam 102 which is moved as a function of the second or engine RPM signal and a cam follower 104 which rides on the cam 102. The cam follower is connected with the extension spring 90 for elongating or relaxing the spring to increase or decrease its biasing pressure. The cam 102 is separated from the engine RPM signal port means 58 by pressure responsive means, in the preferred embodiment a rolling diaphragm 106. A cam biasing spring 108 biases the cam 102 against the pressure of the engine RPM signal. With increasing engine RPM signal pressure, the cam 102 moves away from the engine RPM signal port and with decreasing engine RPM signal pressure the cam biasing spring 108 moves the cam toward the engine RPM signal port. Taken together, the extension spring 90 and the modulating means 100 comprise a means for converting the second fluid signal into a mechanical biasing force which varies with variation in the second fluid signal. A calibration adjustment including a calibrating spring 110 and a threaded calibrating spring compression adjustment means 112 selectively calibrates the position of the cam. In the preferred embodiment, because the engine RPM or second signal is a positive pressure signal, the cam biasing spring 108 is stronger than the calibration spring 110. Thus, in equilibrium the pressure of the engine RPM signal plus the pressure of the calibrating spring 110 are balanced by the control signal biasing spring 108.

Figure 2:
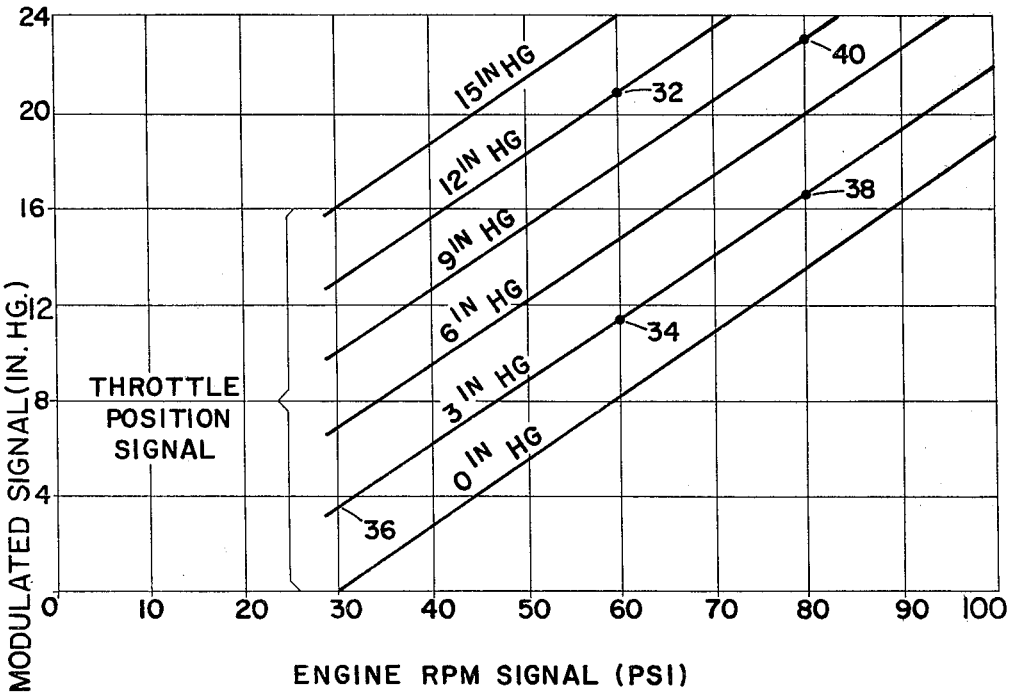
FIG. 2 is a graphic representation of exemplary response characteristics of the modulator valve of FIG. 1.

With reference to FIGS. 2 and 3, the operation of the elements of the modulator valve 20 in conjunction with the preceeding example is provided to clarify the functioning of the valve. At point 32 with the pressure responsive means 68 in the equilibrium position, the first valve means 70 and the second valve means 72 are both closed. As the throttle is advanced and the throttle position signal drops from 12 to 3 in. Hg., between points 32 and 34, the vacuum in the throttle position signal chamber 62 becomes less than the vacuum in the modulated output signal chamber 66. The pressure differential moves the pressure responsive means 68 and the movable valve seat 74 downward opening the first valve means 70 while the second valve means 72 remains closed. The lower vacuum (higher pressure) in the engine RPM signal chamber 62 decreases the vacuum (raises the pressure) in the modulated signal chamber 66 until the forces on the pressure responsive means balance and it returns to the equilibrium position. At point 34 in the graph, a modulated output signal of $9\frac{1}{2}$ in. Hg. moves the pressure responsive means to the equilibrium position. As the vehicle accelerates between points 34 and 38, the engine RPM signal pressure increases moving the rolling diaphragm 106 and cam 102 against the cam biasing means 108, raising the cam follower 104, and increasing the extension of extension spring 90. The increased upward biasing force lifts the pressure responsive means 68, the movable valve seat 74, the first valving element 76, and the second valving element 80. This lifting holds the first valve means 70 closed and opens the second valve means 72 allowing the vacuum supply to draw a greater vacuum in the modulated output signal chamber 66. The modulated output signal vacuum increases until the pressure responsive means 68 draw back down to the equilibrium position. At point 38 on the graph the modulated output signal has increased to $16\frac{1}{2}$ in. Hg. When the throttle position is retarded between points 38 and 40 to hold the achieved speed, the throttle position signal vacuum is increased. The increased vacuum (decreased pressure) in the throttle position signal chamber 62 draws the pressure responsive means 68 upward, again closing the first valve means 70 and opening the second valve means 72. The fluid communication between the modulated input signal chamber and the vacuum supply increases the vacuum (decreases the pressure) in the modulated output signal chamber. When the pressure responsive means 68 is drawn back to the equilibrium position, both the first and second valve means are closed and producing an output signal as noted by point 40 of the graph of about $21\frac{1}{2}$ in. Hg. In the above example, "up" and "down" have been used for convenience of illustration. It is to be appreciated that modulate valve may be positioned in substantially any orientation.

The invention has been described with reference to the preferred embodiment. Obviously, modifications and alterations will occur to others upon reading and understanding the preceeding and detailed description of the preferred embodiment. For example the engine speed may be monitored electronically and the cam 102 may be moved by an electro-mechanical transducer in response to an electric engine RPM signal. The modulator valve 20 may also be used to control a fuel injection pump as a function of engine speed and altitude, and the like. Still further modifications and alterations will occur to others upon reading and understanding the preceeding detailed description of the preferred embodiment. It is intended that the invention be construed as including all such modifications and alterations which come within the scope of the appended claims or the equivalents thereof.

Having thus described a preferred embodiment of the invention, the invention is now claimed to be:

1. A vehicular signal modulation system for producing a modulated output signal which varies as a function of at least a first condition and a second condition, the system comprising;

a first transducer for monitoring the first condition and producing a first fluid signal which varies with the first condition;

a second transducer for monitoring the second condition and producing a second fluid signal which varies with the second condition; and, a modulator valve for modulating one of the first and second fluid signals with the other to produce a modulated output signal which varies with the first and second conditions, the modulator valve including means for converting the second fluid signal to a biasing force and a pressure responsive means operatively connected with the converting means and the first transducer to produce the modulated output signal.

2. The system as set forth in claim 1 wherein the first transducer is a throttle position monitor and the first fluid signal varies with throttle position.

3. The system as set forth in claim 2 wherein the first fluid signal varies inversely with throttle position advancement.

4. The system as set forth in claim 3 wherein the first fluid signal is a vacuum signal.

5. The system as set forth in claim 1 wherein the second transducer monitors engine speed and the second fluid signal varies with engine speed.

6. The system as set forth in claim 5 wherein the engine speed monitoring means is operatively connected with a diesel engine transfer oil injector pump and the second fluid signal varies with the oil pressure of the transfer oil injector pump.

7. The system as set forth in claim 2 wherein the second transducer monitors engine speed and the second fluid signal varies with engine speed.

8. The system as set forth in claim 7 wherein the modulator valve is operatively connected with an exhaust gas recirculation valve for controlling exhaust gas recirculation as a function of the throttle position and the engine speed.

9. The system as set forth in claim 1 wherein the first fluid signal varies with altitude and the second fluid signal varies with engine speed.

10. The system as set forth in claim 1 wherein the converting means includes an adjustable biasing means for applying the adjustable force to the pressure responsive means and a modulating means for adjusting the biasing force of the adjustable biasing means, the modulating means being operatively connected with the second transducer for adjusting the biasing force as a function of the second fluid signal.

11. The system as set forth in claim 10 wherein the modulator valve further includes:

a first signal chamber which is disposed in fluid communication with the first transducer;

a modulated output signal chamber in which the modulator output signal is produced;

the pressure responsive means being disposed with one side in fluid communication with the first signal chamber and the other side in fluid communication with the modulated output signal chamber, the pressure responsive means attaining an equilibrium position when forces on its two sides are balanced;

a first valve means for selectively providing fluid communication between the first signal chamber and the modulated output signal chamber in response to the pressure responsive means moving from the equilibrium position in response to a lower force on its modulated output signal chamber side than on its first signal chamber side; and, a second valve means for selectively connecting the modulating output signal chamber with a fluid supply means in response to the pressure responsive means moving from the equilibrium position in response to a lower force on the first signal chamber side than on the modulated output signal chamber side.

12. The system as set forth in claim 11 wherein the modulating means includes a diaphragm having one face disposed in fluid communication with the second transducer, a cam which is operatively connected with the diaphragm for motion therewith, and a cam follower which is operatively connected between the cam and the adjustable biasing means for adjusting the bias as a function of cam position, whereby the adjustable biasing means is adjusted as a function of the second fluid signal.

13. The system as set forth in claim 12 wherein the adjustable biasing means is an extension spring operatively connected with the cam follower and the pressure responsive means.

14. The system as set forth in claim 13 further including a cam biasing spring for biasing the cam against the second fluid signal pressure.

15. The system as set forth in claim 14 wherein the modulating means further includes a calibration spring for exerting a pressure against the cam and a calibration adjustment means for selectively adjusting the compression of the calibration spring.

16. The system as set forth in claim 12 wherein the first valve means includes a movable valve seat which is operatively connected with the pressure responsive means for movement therewith and a first valving element for selectively permitting and preventing fluid communication through the movable valve seat between the first signal chamber and the modulated output signal chamber and wherein the second valving means includes a stationary valve seat and a second valving element for selectively permitting and preventing fluid communication between the modulated output signal chamber and the fluid supply means, the first and second valving elements being operatively connected to undergo coordinated relative movement.

17. A vehicular signal modulation system for producing a modulated output signal which varies as a function of altitude and engine speed, the system comprising:

means for sensing the altitude of a vehicle and for producing a first fluid signal which varies with the altitude;

an engine speed monitor for monitoring engine speed and for producing an engine RPM signal which varies with engine speed; and, a modulator valve for modulating one of the altitude signals and the engine RPM signal with the other to produce a modulated output signal which varies as a function of both altitude and engine speed.

18. A modulator valve for modulating a first fluid signal and a second fluid signal, the modulator valve comprising:

means for defining a first fluid signal receiving port;

means for defining a second fluid signal receiving port;

means for defining a modulated output signal port;

means for defining a fluid pressure supply receiving port;

a first signal chamber disposed in fluid communication with the first fluid signal port means;

a modulated output signal chamber in which a modulated signal is produced, the modulated signal chamber being operatively connected with the modulated output signal port means;

a movable, pressure responsive means disposed to receive opposing forces from fluid pressure in the first signal chamber and fluid pressure in the modulated output signal chamber, the pressure responsive means attaining an equilibrium position when forces on it are balanced;

an adjustable biasing means for applying an adjustable biasing force to the pressure responsive means;

modulating means for adjusting the biasing force of the adjustable biasing means, the modulating means being disposed in fluid communication with the second fluid signal port means;

first valve means for selectively providing fluid communication between the first signal chamber and the modulated output signal chamber in response to the pressure responsive means moving from the equilibrium position in a first direction; and a second valve means for selectively connecting the modulated output signal chamber with the fluid pressure supply port means in response to the pressure responsive means moving from the equilibrium position in a second direction, whereby the first and second valve means adjust the pressure in the modulated output signal chamber such that the pressure responsive means is returned to the equilibrium position.

19. The modulator valve as set forth in claim 18 wherein the modulating means includes means for defining a force movable means disposed in fluid communication with the second fluid signal port means to be moved in response to changes in the pressure of the second fluid signal, and mechanical interconnecting means for connecting the force movable means with the adjustable biasing means such that changes in the second fluid change the bias of the adjustable biasing means.

20. The modulator valve as set forth in claim 19 wherein the adjustable biasing means includes an extension spring and wherein the modulating means compresses and extends the spring to adjust its biasing force.

21. The modulator valve as set forth in claim 20 wherein the modulating means includes a cam which is connected with the force movable means for movement therewith and a cam follower connected between the cam and the extension spring for adjusting the extension and compression of the extension spring.

22. The modulator valve as set forth in claim 21 wherein the force movable means includes a diaphragm.

23. The modulator valve as set forth in claim 22 wherein the diaphragm is a rolling diaphragm.

24. The modulator valve as set forth in claim 21 further including a cam biasing spring for biasing the cam against the control signal pressure.

25. The modulator valve as set forth in claim 24 wherein the modulating means further includes a calibrating spring for exerting a pressure against the cam biasing spring and calibration adjustment means for selectively adjusting the compression and extension of the calibrating spring.

26. The modulator valve as set forth in claim 19 wherein the first valve means includes a movable valve seat which is operatively connected with the pressure responsive means for movement therewith and a first valving element for selectively permitting and preventing fluid communication through the movable valve seat.

27. The modulator valve as set forth in claim 26 wherein the second valving means includes a stationary valve seat and a second valving element for selectively permitting and preventing fluid communication between the modulated output signal chamber and the fluid pressure supply port means, the first and second valving elements being operatively connected such that they undergo coordinated relative movement.

28. The modulator valve as set forth in claim 27 wherein the fluid pressure supply is a vacuum supply, the first fluid signal is a vacuum signal and the modulated output signal is a vacuum signal.

29. The modulation valve as set forth in claim 28 wherein the second fluid signal is a positive fluid pressure signal.

30. A method of producing a modulated output signal which varies as a function of at least throttle position and a second condition, the method comprising:

monitoring the throttle position and producing a first fluid signal which varies with the throttle position;

monitoring the second condition and producing a second fluid signal which varies with the second condition, converting the second fluid signal to a mechanical biasing force; and, combining the first fluid signal and the mechanical biasing force to produce a modulated output signal.

31. The method as set forth in claim 30 wherein the second condition is engine speed of the diesel engine.

32. The method as set forth in claim 30 wherein the second condition is the oil pressure of a transfer oil injector pump of the diesel engine.

33. The method as set forth in claim 30 wherein producing the modulated output signal includes applying the biasing force, the first fluid signal, and the modulated output signal to a movable, pressure responsive means and varying the modulated output signal to retain the movable pressure responsive means is in equilibrium position.

34. The method as set forth in claim 33 wherein converting the second fluid signal to a mechanical biasing force includes controlling a cam position with the second fluid signal and adjusting the extension of a spring which is connected with the pressure responsive means with variations in the cam position.

35. In a diesel engine, a method of producing a modulated output signal which varies as a function of at least a first condition and oil pressure of a transfer oil injector pump, the method comprising:

monitoring the first condition and producing a first fluid signal which varies with the first condition;

monitoring the transfer oil injector pump oil pressure and producing a second fluid signal which varies with the transfer oil injector pump oil pressure;

converting one of the first and second fluid signals to a mechanical biasing force; and, combining the mechanical biasing force with the other of the first and second fluid signals to produce a modulated output signal.

* * * * *